US009095974B2

(12) United States Patent
Verson

(10) Patent No.: US 9,095,974 B2
(45) Date of Patent: Aug. 4, 2015

(54) MATERIAL CAROUSEL

(71) Applicant: Siemens Industry, Inc., Alpharetta, GA (US)

(72) Inventor: Benjamin Arden Verson, Buffalo Grove, IL (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 14/260,931

(22) Filed: Apr. 24, 2014

(65) Prior Publication Data

US 2014/0231368 A1 Aug. 21, 2014

Related U.S. Application Data

(62) Division of application No. 13/369,681, filed on Feb. 9, 2012, now Pat. No. 8,727,140.

(51) Int. Cl.

| | |
|---|---|
| ***A47F 5/02*** | (2006.01) |
| ***A47F 5/08*** | (2006.01) |
| ***A47F 7/00*** | (2006.01) |
| ***A47B 43/00*** | (2006.01) |
| ***A47B 47/00*** | (2006.01) |
| ***A47B 57/00*** | (2006.01) |

(Continued)

(52) U.S. Cl.

CPC *B25H 1/00* (2013.01); *A47B 49/00* (2013.01); *A47F 5/0037* (2013.01); *A47F 5/02* (2013.01); *A47F 5/05* (2013.01); *A47F 5/0807* (2013.01); *A47F 7/00* (2013.01); *B25H 1/12* (2013.01); *Y10T 403/10* (2013.01)

(58) Field of Classification Search

CPC ..... D06F 57/02; D06F 57/04; B25H 1/00; B25H 1/12; B25H 3/04; F16L 3/18; A47F 5/04; A47F 5/02; A47F 5/05; A47F 5/06; A47F 3/08; A47F 3/10; A47F 3/11; A47F 7/24; A47F 5/0892; A47F 7/146; A47F 5/0037; A47F 5/0823; A47F 5/0876; A47F 5/006; A47F 5/0807; A47F 7/00; A47G 25/746; A47G 25/0685; A47G 25/0664; A47B 49/00; A47B 63/062; A47B 61/003; A47B 61/02; A47B 49/004; A47B 2063/005; A47B 81/065; F16M 13/02; Y10T 403/10

USPC ..... 211/53, 56, 39, 61, 78, 70, 95, 96, 163, 211/115, 165, 196, 197, 205, 166, 13.1, 58, 211/54.1, 57.1, 59.1, 7, 1.3, 131.1, 129.1; 221/122; 248/349.1, 219.4, 218.4

See application file for complete search history.

(56) References Cited

U.S. PATENT DOCUMENTS

| | | | |
|---|---|---|---|
| 450,146 | A | 4/1891 | Gibford |
| 452,792 | A | 5/1891 | Jones |

(Continued)

*Primary Examiner* — Jennifer E Novosad

(57) ABSTRACT

A material carousel for manufacturing and/or assembly operations is provided. The carousel includes a hub fabricated from a low friction material wherein the hub has a polygonal shape. The carousel also includes a plurality of equally spaced arms which are press fit into the hub. Each arm is adapted to hold cable and/or harness assemblies or includes a bin for holding materials used for production operations. In addition, the carousel includes a support column that extends through the hub, wherein the hub is adapted to rotate about the support column. An adjustable support column is also provided for supporting the hub on the support column. Further, the carousel includes a peg mechanism for stopping rotation of the hub after a predetermined rotation angle.

9 Claims, 6 Drawing Sheets

(51) Int. Cl.

| | |
|---|---|
| ***B25H 1/00*** | (2006.01) |
| ***A47F 5/05*** | (2006.01) |
| ***A47F 5/00*** | (2006.01) |
| ***A47B 49/00*** | (2006.01) |
| ***B25H 1/12*** | (2006.01) |

(56) References Cited

U.S. PATENT DOCUMENTS

| | | | | | |
|---|---|---|---|---|---|
| 730,675 | A | | 6/1903 | Macklin | |
| 883,162 | A | | 3/1908 | Baeoker | |
| 1,243,173 | A | | 10/1917 | Hinckley | |
| 1,259,623 | A | | 3/1918 | Herrick | |
| 1,729,004 | A | | 9/1929 | Miadowicz | |
| 1,807,990 | A | | 6/1931 | Landers | |
| 2,324,596 | A | | 7/1943 | Mark Quain | |
| 2,542,137 | A | | 2/1951 | Hanson | |
| 2,595,837 | A | | 5/1952 | Freeman | |
| 2,964,201 | A | | 12/1960 | Huffman | |
| 3,255,890 | A | * | 6/1966 | Gerber | 211/163 |
| 3,734,301 | A | * | 5/1973 | Rastocny | 211/205 |
| 3,826,378 | A | | 7/1974 | Novak | |
| 3,957,159 | A | * | 5/1976 | Radek | 211/4 |
| 4,141,453 | A | * | 2/1979 | Hanan | 211/163 |
| 4,222,490 | A | * | 9/1980 | Wood, Jr. | 211/70.5 |
| 4,253,576 | A | | 3/1981 | Ford et al. | |
| 4,534,471 | A | | 8/1985 | Zahn et al. | |
| 4,688,685 | A | | 8/1987 | Brace | |
| 4,770,303 | A | * | 9/1988 | Boyd | 211/205 |
| 4,971,204 | A | * | 11/1990 | Alsobrook | 211/85.13 |
| 5,037,049 | A | * | 8/1991 | Funk | 248/165 |
| 5,038,946 | A | | 8/1991 | Tenser et al. | |
| 5,074,421 | A | | 12/1991 | Coulter | |
| 5,330,065 | A | | 7/1994 | Bradley | |
| 5,385,397 | A | * | 1/1995 | Chow | 312/9.45 |
| 5,458,249 | A | * | 10/1995 | Shang-Lu | 211/197 |
| 5,524,775 | A | * | 6/1996 | Kaine | 211/131.1 |
| 5,535,895 | A | | 7/1996 | Valiulis | |
| 5,676,261 | A | | 10/1997 | Baughman et al. | |
| 5,839,586 | A | | 11/1998 | Smith | |
| 6,206,493 | B1 | * | 3/2001 | Sanchez-Levin et al. | 312/125 |
| 6,241,105 | B1 | | 6/2001 | Pomper | |
| 6,325,220 | B1 | | 12/2001 | Malmstrom | |
| 6,543,631 | B1 | | 4/2003 | Sawyers | |
| 6,868,975 | B2 | * | 3/2005 | Sells et al. | 211/4 |
| 7,207,450 | B1 | | 4/2007 | Franklin et al. | |
| 2004/0238462 | A1 | | 12/2004 | Schulz | |
| 2011/0147324 | A1 | * | 6/2011 | Sankey et al. | 211/59.2 |

* cited by examiner

MATERIAL CAROUSEL

CROSS REFERENCE TO RELATED APPLICATIONS

This application is a divisional of and claims priority to U.S. application Ser. No. 13/369,681, filed Feb. 9, 2012 and entitled MATERIAL CAROUSEL, the disclosure of which is incorporated by reference in its entirety.

FIELD OF THE INVENTION

This invention relates to manufacturing and/or assembly operations, and more particularly, to a material carousel having a support column and a hub rotatably attached to the support column wherein the hub includes a plurality of equally spaced arms each adapted to hold cable and/or harness assemblies or which include a bin for holding materials used for production operations.

BACKGROUND OF THE INVENTION

Many manufacturing and assembly facilities are designed to provide lean manufacturing practices which minimize movement, material requirements, waste and optimize factory floor utilization in order to perform the same or additional tasks while saving costs. Such facilities include several work areas or cells where various manufacturing and/or assembly operations (i.e. production operations) are performed by operators. In order to provide lean manufacturing practices, many of the work cells are arranged in either a substantially "L" or "U" shaped configuration.

Manufacturing and assembly facilities frequently utilize workbenches for performing production operations. Referring to FIG. 1, a first workbench 10 is shown located at an approximately 90 degree orientation relative to a second workbench 12 to form an "L" shaped configuration. An exemplary workflow is indicated by first 14 and second 16 arrows which correspond to the orientation of the first 10 and second 12 workbenches. In particular, the first arrow 14 depicts a direction of a sequence of production operations that progresses in a first direction on the first workbench 10 and then changes direction by approximately 90 degrees and continues in a second direction on the second workbench 12.

Materials used in production operations, such as small parts or assemblies, are typically located in a rear portion 18 of the workbenches 10,12 away from first 20 and second 22 operators. Thus, accessibility to the materials (indicated by arrow 30) is difficult for either operator 20,22 due to the location of the small parts or assemblies on the workbenches 10,12. In addition, replenishment of material by material handlers directly on the rear portion 18 of each workbench 10,12 (indicated by arrow 32) results in a disruption of production operations.

Moreover, due to the orientation of the first 10 and second 12 workbenches, an empty space 24 is formed adjacent to first 26 and second 28 ends of the first 10 and second 12 workbenches, respectively. Due to its location, the space 24 cannot be used as part of production operations, thus resulting in unusable factory floor space. Further, the amount of unusable factory floor space is doubled if a configuration is used wherein three workbenches are arranged in a "U" shape thus forming two unusable spaces 24.

SUMMARY OF THE INVENTION

A material carousel for manufacturing and/or assembly operations is disclosed. The carousel includes a hub having a plurality of arms, wherein each arm is adapted to hold cable and/or harness assemblies or includes a bin for holding materials used for production operations. The carousel also includes a support column extending through the hub, wherein the hub is adapted to rotate about the support column. An adjustable support collar is also provided for supporting the hub on the support column. Further, the carousel includes a peg mechanism for stopping rotation of the hub after a predetermined rotation angle.

DESCRIPTION OF THE INVENTION

Figure 1:
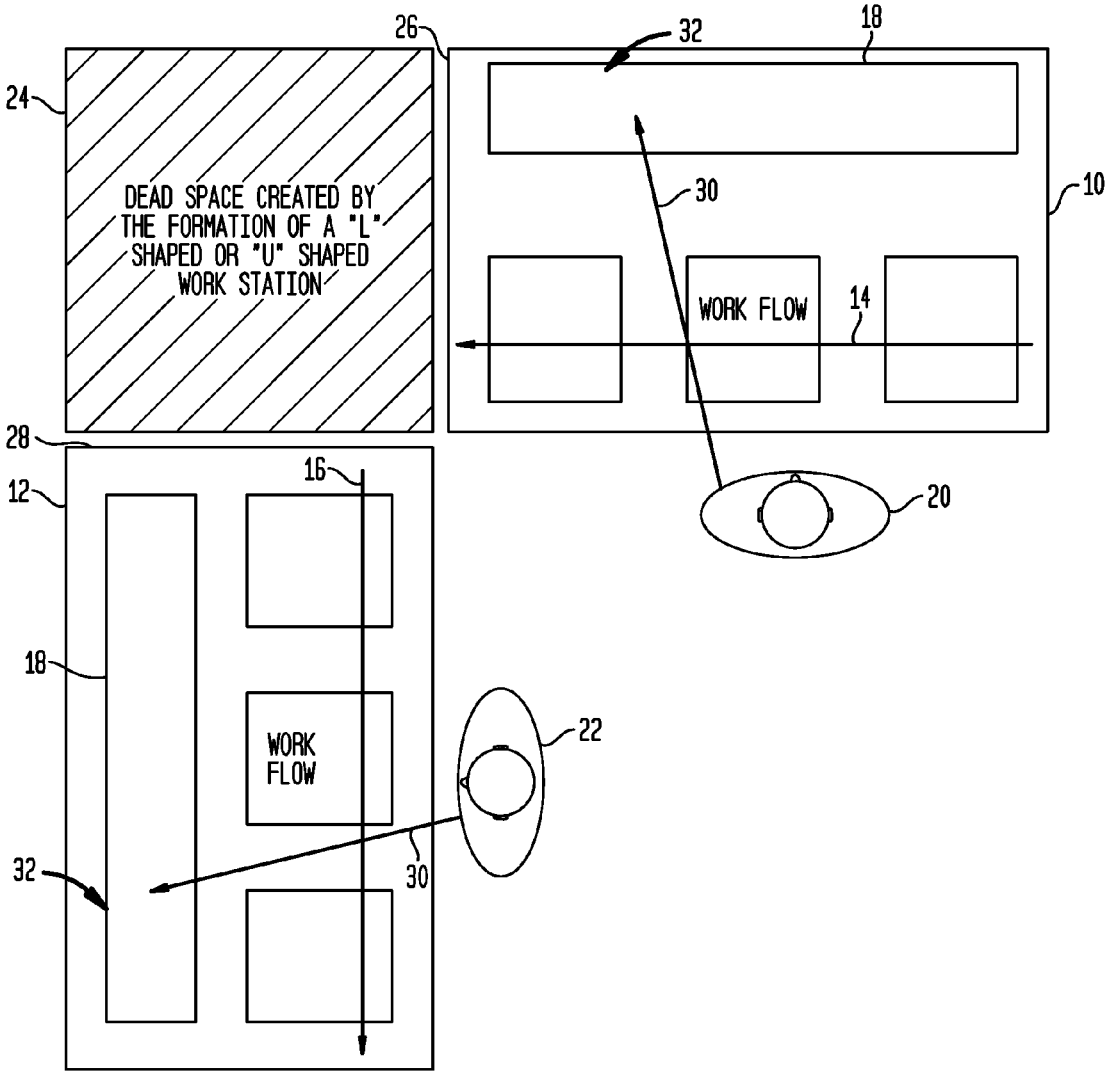
FIG. 1 depicts first and second workbenches used in a manufacturing and/or assembly facility which are arranged in an "L" shaped configuration and form a space.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings. In the description below, like reference numerals and labels are used to describe the same, similar or corresponding parts in the several views of FIGS. 1-6.

Figure 2:
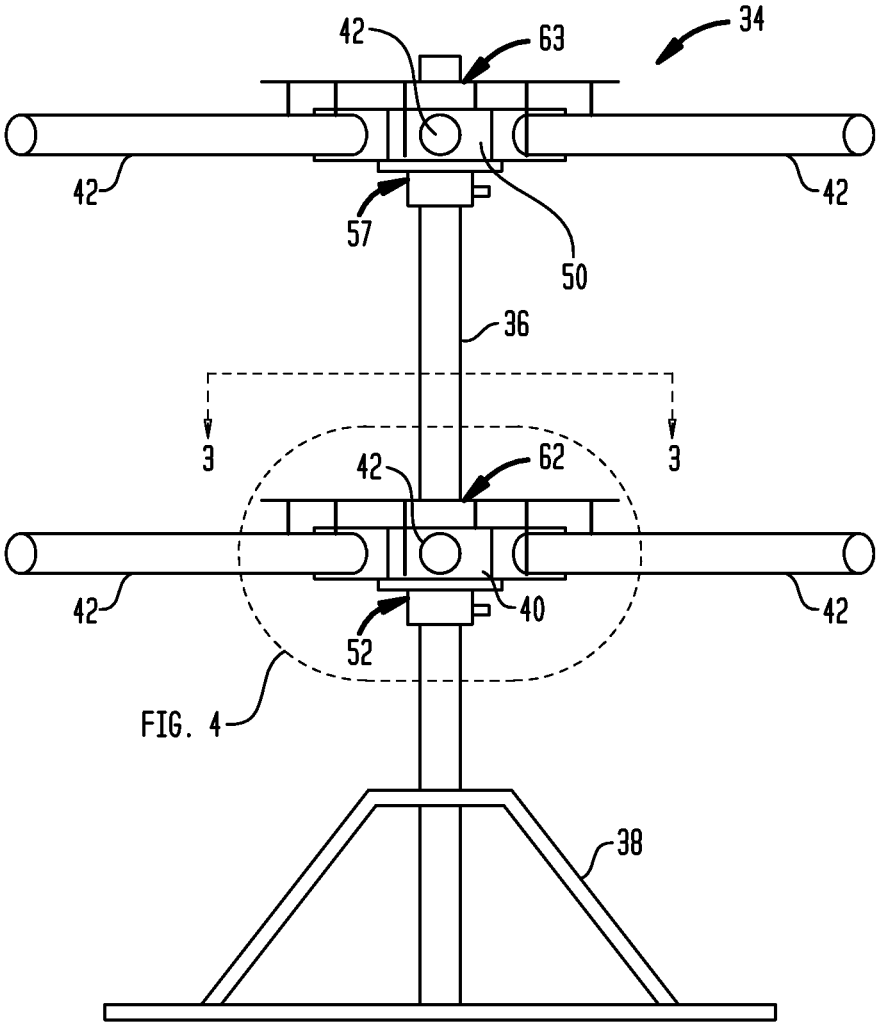
FIG. 2 depicts a center column, first and second hubs and horizontal arms for a material carousel in accordance with the present invention.
Figure 3:
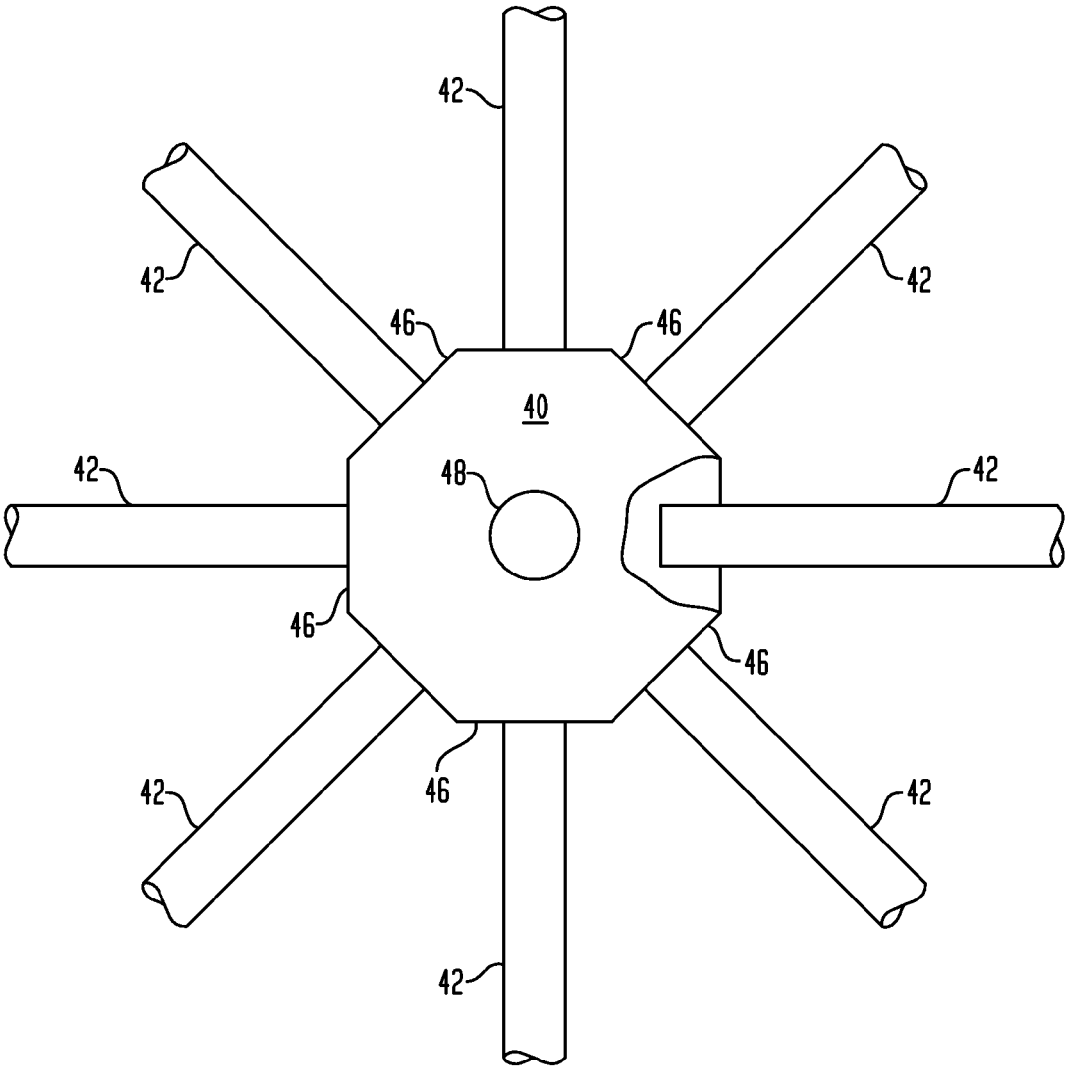
FIG. 3 is a top view of the first hub along view line 3-3 of FIG. 2.

Referring to FIG. 2, a material carousel 34 in accordance with the present invention is shown. The carousel 34 includes a vertical support column 36 that is supported by a stand 38. The support column 36 extends through a first hub 40 (or center member) that includes a plurality of outwardly extending horizontal arms 42. Referring to FIG. 3, a top view of the first hub 40 along view line 3-3 of FIG. 2 is shown without a first mechanism 62 as will be described. In one embodiment, the first hub 40 is octagonally shaped and includes eight arms 42. Alternatively, the first hub 40 may be round although other shapes may be used. The first hub 40 may be fabricated from a material having low friction characteristics sufficient to enable the first hub 40, and thus the associated arms 42, to freely rotate about the support column 36. In one embodiment, the first hub 40 is fabricated from a plastic material or Delrin® acetal resin. Acetal resin has natural lubricity that provides low friction characteristics which enable rotation of the first hub 40 about the support column 36, thus eliminating the need for a rotational bearing. Other structural materials and plastics may also be used for fabricating the first hub 40. In one embodiment, the first hub 40 has a diameter of approximately 152.4 mm and a thickness of approximately 41.1 mm to support one or more arms 42 (and up to at least twelve arms 42) having a length of two or more feet while bearing a load of approximately ten pounds on the distal end of each arm 42 extending from the hub 40. However, as further described herein the number of arms 42, length of each arm 42, and diameter of each arm 42 may be varied or increased relative to the diameter of a center hole 48 of the hub 40 and corresponding diameter of the vertical support column 36 without varying or increasing the diameter or thickness of the hub 40.

Figure 4:
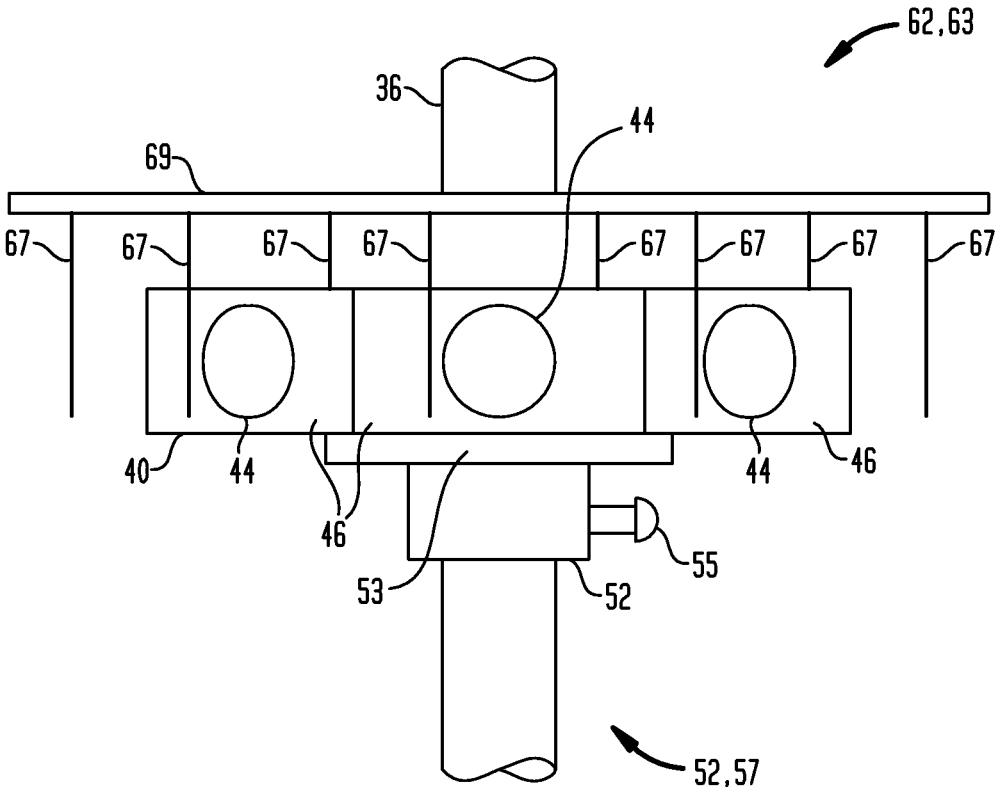
FIG. 4 is an enlarged view of balloon section 4 in FIG. 2 depicting the first hub without the arms.

The support column 36 and arms 42 may be fabricated from commercially available materials and configured as tubing or pipes although other shapes may also be used. FIG. 4 is an enlarged view of balloon section 4 in FIG. 2 without the arms 42. An end of each arm 42 may be inserted or press fit into a corresponding side hole or recess 44 in a corresponding side surface 46 (or side wall) of the first hub 40 and is held therein by the press fit. This serves to reduce or eliminate the need for screw clamp connectors or other fasteners for attaching the arms 42 to the first hub 40. In addition, the press fit is sized so that the end of each arm 42 is removably engaged with the corresponding recess 40. This enables removal of each arm 42 and subsequent reassembly so that the carousel 34 may be relocated to a different location in a factory, for example. In addition, removable engagement of the arms 42 enables replacement of a set of arms 42 with an alternate set of arms 42 whose length may be shorter or longer than the original arms 42, for example.

In one embodiment, first hub 40 includes eight flat bottom, 27.7 mm diameter side recesses 44 located at equal angles of 45 degrees relative to an adjacent recess 44 and centered on each side surface or side wall 46. The arms 42 may each have a diameter of approximately 28 mm to thus provide a press fit when inserted into a corresponding side recess 44. Referring back to FIG. 3, the first hub 40 includes a center hole 48 for receiving the support column 36. The center hole 48 may be either a 30 mm diameter through hole for use with light duty piping or a 44 mm diameter through hole for heavy duty pipe. Further, the center hole 48 and side recesses 44 of the first hub 40 may be enlarged in order to enable the use of a larger support column and arms to enable the carousel 34 to support heavier materials on the distal ends of the arms 42 without increasing the diameter or thickness of the hub 40. In use, each arm 42 may support a load of up to approximately ten pounds. Accordingly, a range of sizes may be used for the diameters and lengths of the arms 42 and corresponding diameters and depths of the recesses 44 in order to support a pre-determined load on the arms 42 and also provide a press fit. As best shown in FIG. 3, the hub 40 (or center member) has a center axis (corresponding to a vector orthogonal to the page in FIG. 3 and running through a center point of the center hole 48 of the hub 40) and a plurality of side walls 46 circumferentially spaced about the center axis of the hub 40. The first or center hole 48 formed in the hub or center member 40 is sized to receive the support column. The plurality of second or side holes 44 are each formed in a respective side wall 46 for receiving the arms 42.

Referring back to FIG. 2 in conjunction with FIG. 4, the carousel 34 also includes a second hub 50 having associated outwardly extending horizontal arms 42 as previously described. In other embodiments, additional hubs and associated horizontal members may be used. The first 40 and second 50 hubs are each held in position on the support column 36 by first 52 and second 57 support collars, respectively. The first 52 and second 57 support collars each include a flange portion 53 that contacts and supports the first 40 and second 50 hubs. The support column 36 extends through a through hole in the first 52 and second 57 support collars. The first 52 and second 57 support collars are movable on the support column 36 to enable positioning of the hubs 40,50 at different locations along the support column 36 and thus locate the first 40 and second 50 hubs at desired heights relative to the floor. Once a desired location for each of the hubs 40,50 is found, the associated support collar 52, 57 is removably affixed to the support column 36 by tightening fastener 55 that threads through the collar 52, 57 to engage the support column 36 thus locating each associated hub 40,50 at a desired height above the floor.

Alternatively, the support column 36 may have a plurality of transverse through holes through which a pin is inserted in order to removably attach each of the hubs 40,50 in a desired location on the support column 36. In still another embodiment, a hub having a dodecagonal shape may be used which includes twelve arms that extend from the hub. In addition, hubs having other polygonal shapes may be used. In each embodiment, the hub 40 or center member rotates about the support column 36 and is fabricated from a material having low friction characteristics sufficient to enable the hub 40 or center member to freely rotate about the support column while the center member is supported on the flange 53 of the support collar 52.

The carousel 34 may also include first 62 and second 63 mechanisms for independently stopping rotation of the first 40 and second 50 hubs, respectively. In one embodiment, the first 62 and second 63 mechanisms each include a plurality of thin resilient members or pegs 67 which extend downward from a stationary plate element 69 affixed to the support column 36. Upon rotation of a hub 40,50 by an operator, the arms 42 continually strike the pegs 67 which causes the pegs 67 to deflect. This slows down and ultimately stops rotation of the hub 40,50. Alternatively, the pegs 67 may be configured to be sufficiently stiff so as to stop rotation of the hub 40,50 after a predetermined angular rotation. By way of example, the pegs 67 are fabricated from a resilient material such as plastic. In alternative embodiments, the first 62 and second 63 mechanisms may be either a cam or a ratchet mechanism.

Figure 5:
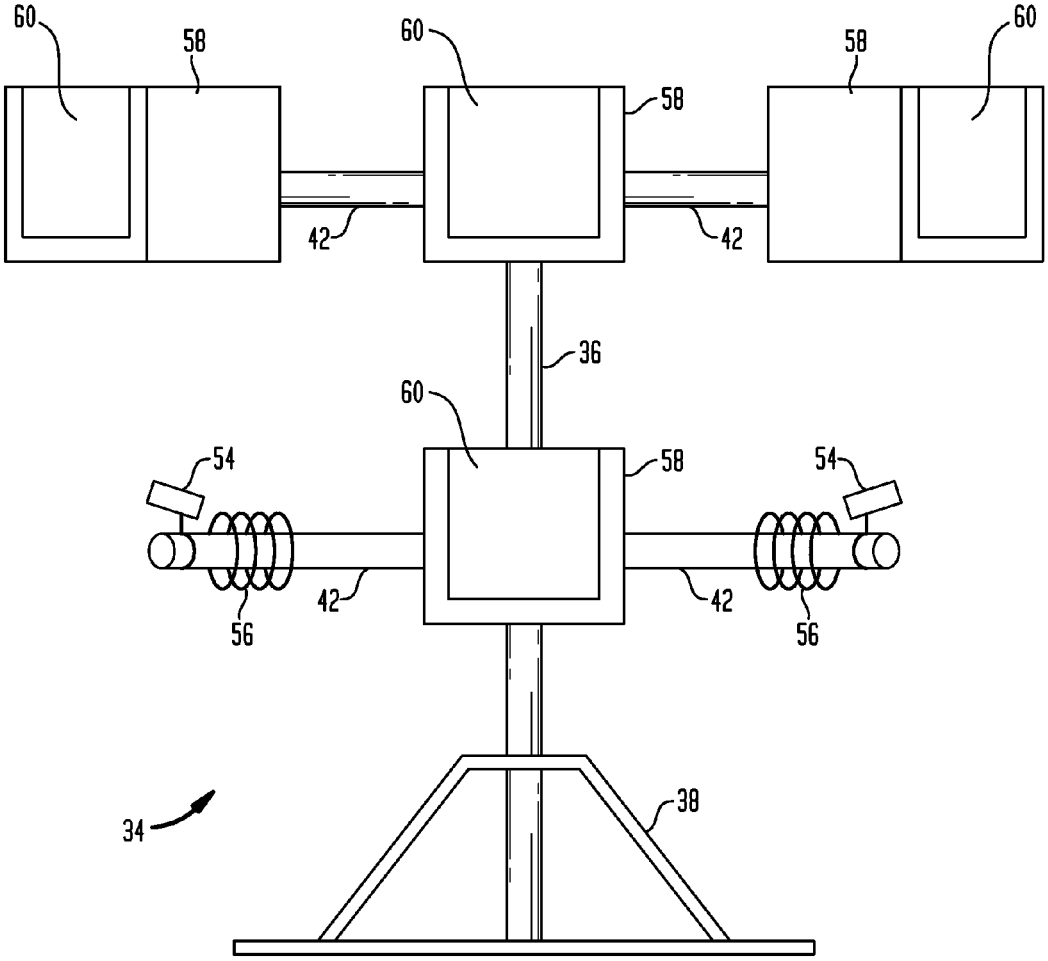
FIG. 5 depicts one embodiment of the material carousel.

Referring to FIG. 5, the arms 42 are configured to hold various types of material such as cable and/or harness assemblies 56 and may include a label 54 for identifying the cables and harness assemblies 56 held on the respective arm 42. Alternatively, an end of each of the arms 42 may be configured to hold a material bin 58. Each bin 58 includes a cavity 60 for holding components and various assemblies used for production operations. The bins 58 may have different sizes to accommodate the size of the material being used. By way of example, FIG. 5 depicts the carousel 34 configured with two of the arms 42 adapted for holding cable and/or harness assemblies 56 and the remaining arms 42 having bins 58 for holding components and various assemblies or paper instructions, for example. In accordance with the invention, the carousel 34 may be reconfigured as desired to increase or decrease the number of bins 58 or the number of arms 42 configured to hold cable and/or harness assemblies 56.

Figure 6:
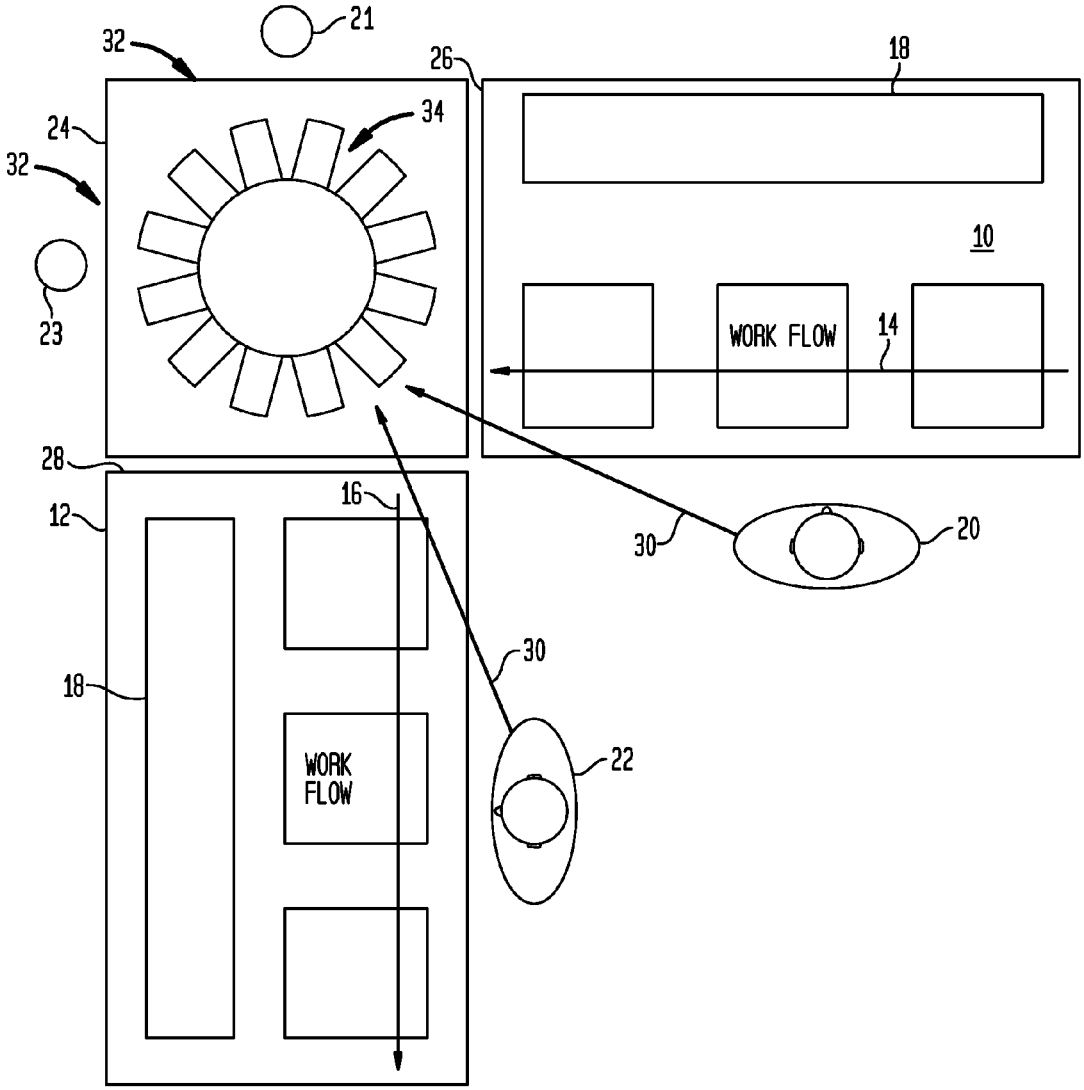
FIG. 6 shows the material carousel positioned in the space formed by the first and second workbenches.

Each bin 58 and arm 42 rotates about the support column 36 via the respective hubs 40. In order to obtain a desired part, an operator may push on a portion of the carousel 34, such as an arm 42 or a bin 58, to rotate the carousel 34 in a clockwise or counterclockwise direction so that a desired part is readily accessible to the operator. Referring to FIG. 6, the carousel 34 is shown positioned in the space 24 formed by and adjacent to the first 26 and second 28 ends of the first 10 and second 12 workbenches. Therefore, previously unusable factory floor space formed by "L" or "U" shaped workbench configurations is now used, thus optimizing factory floor usage. By way of example, an area of approximately between 9 and 12 square feet becomes usable as a result of the current invention. Further, both operators 20,22 are able to access (indicated by arrows 30) the carousel 34 and thus materials needed for production operations. This provides an improved ergonomic work environment for both operators 20,22 since materials which were previously located in difficult to reach areas such as the rear portion 18 of workbenches 10,12 are now readily accessible on the carousel 34. In addition, material handlers 21,23 are able to access the carousel 34 to replenish (indicated by arrows 32) materials and bins without disrupting production operations thus further improving the ergonomic aspects of the work environment. In one embodiment, the first 10 and second 12 workbenches are oriented substantially perpendicular to each other to form the space 24. The carousel 34 is positioned in the space 24 to provide operators 20,22 or material handlers 21,23 positioned on either side of each workbench 10,12 access to the carousel 34 and to enable rotation of the arms 42 to obtain a desired object.

Therefore, the current invention provides a freestanding, free rotating material carousel 34 which supports lean manufacturing practices while also optimizing factory floor utilization. Further, the carousel 34 is applicable across all material handling areas, and is scalable based on the particular material type.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations.

What is claimed is:

1. A hub assembly for a material carousel having a support column and a plurality of arms, comprising:

a center member having a center axis and a plurality of side walls circumferentially spaced about the center axis;

a first hole formed in the center member for receiving the support column wherein the center member is rotatable about the support column;

a plurality of second holes each formed in a respective side wall wherein each second hole receives an arm and wherein rotation of the center member rotates the arms in an arm rotation path about the support column; and a peg mechanism having a plurality of downwardly extending resilient pegs wherein the pegs are located in the arm rotation path and wherein the arms strike the pegs during rotation of the arms to stop rotation of the arms.

2. The hub according to claim 1, wherein the center member rotates about the support column and is fabricated from a material having low friction characteristics sufficient to enable the center member to freely rotate about the support column while the center member is adapted to be supported on a support collar.

3. The hub according to claim 1, wherein the center member is octagonally shaped.

4. The hub according to claim 1, wherein the arms are press fit into the second holes.

5. The hub according to claim 4, wherein the second holes are formed in the side walls such that the arms are equally spaced about the center member.

6. The hub according to claim 1, wherein the center member is fabricated from acetal resin.

7. The hub according to claim 1, wherein the center member is dodecagonally shaped.

8. The hub according to claim 1, wherein each arm further includes a label that identifies cables and harness assemblies held on the respective arm.

9. A material carousel, comprising:

a hub having a polygonal shape wherein the hub is fabricated from a low friction material; and a plurality of equally spaced arms extending from the hub, wherein each arm is adapted to hold cable or harness assemblies or includes a bin for holding materials used for production operations and wherein each arm is press fit into the hub;

a support column extending through the hub, wherein the hub is adapted to rotate about the support column and wherein rotation of the hub rotates the arms in an arm rotation path about the support column;

an adjustable support collar for supporting the hub on the support column; and a peg mechanism having a plurality of downwardly extending resilient pegs wherein the pegs are located in the arm rotation path and wherein the arms strike the pegs during rotation of the arms to stop rotation of the arms.

* * * * *